US006384537B2

(12) United States Patent
Whyman

(10) Patent No.: US 6,384,537 B2
(45) **Date of Patent: *May 7, 2002**

(54) DOUBLE LOOP OUTPUT SYSTEM FOR MAGNETRON

(75) Inventor: Neil G. Whyman, Williamsport, PA (US)

(73) Assignee: Northrop Grumman Corporation, Los Angeles, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/382,726

(22) Filed: Aug. 25, 1999

(51) Int. Cl.[7] ..... H01J 23/46
(52) U.S. Cl. ..... 315/39.53; 315/39.51
(58) Field of Search ..... 315/39.53, 39.51

(56) References Cited

U.S. PATENT DOCUMENTS

| | | | | |
|---|---|---|---|---|
| 2,884,563 A | * | 4/1959 | Crook et al. | 315/39.53 |
| 3,289,023 A | * | 11/1966 | Adikes et al. | 315/39.53 |
| 3,536,953 A | * | 10/1970 | Van de Goor | 315/39.51 X |
| 4,207,496 A | | 6/1980 | Nakai | 315/39.53 |
| 4,833,367 A | | 5/1989 | Harada | 315/39.53 |
| 4,891,557 A | | 1/1990 | Nobue et al. | 315/39.51 |
| 5,017,891 A | | 5/1991 | Jerram et al. | 331/88 |
| 5,180,946 A | | 1/1993 | Aiga et al. | 315/39.51 |
| 5,894,199 A | | 4/1999 | Pasco | 315/39.55 |

FOREIGN PATENT DOCUMENTS

| | | | | |
|---|---|---|---|---|
| DE | 1162000 | * | 1/1964 | 315/39.53 |
| EP | 0 791 947 A1 | | 8/1997 | |
| GB | 747917 | | 4/1956 | |
| GB | 827360 | | 2/1960 | |
| GB | 1080656 | | 8/1967 | |

* cited by examiner

*Primary Examiner*—Benny T. Lee
(74) *Attorney, Agent, or Firm*—O'Melveny & Myers LLP

(57) ABSTRACT

A magnetron comprises an anode ring concentrically disposed around and spaced from a cathode. The anode ring further comprises a plurality of anode vanes extending radially toward the cathode with cavities being defined between adjacent ones of the plurality of anode vanes. One of the plurality of anode vanes provides an output vane whereby a high power microwave signal is developed in first and second output cavities disposed at either respective side of the output vane. The high power microwave signal is coupled out of both the first and second output cavities by a coaxial transmission line that includes first and second coupling loops disposed in the first and second output cavities, respectively. The output vane further comprises an opening at a central portion thereof. The first and second coupling loops share a common central portion that extends through the opening of the output vane without contacting the output vane. The common central portion extends outwardly of the anode ring to permit communication of the high power microwave signal therefrom. The output circuit further comprises an outer body portion that engages a corresponding bore extending axially through the anode ring. The first and second coupling loops are coupled to an end of the outer body portion that engages the anode ring. The first and second coupling loops are oriented substantially perpendicular to the output vane. The output circuit further comprises an antenna for communication of the high power microwave signal therefrom.

24 Claims, 3 Drawing Sheets

FIG. 3
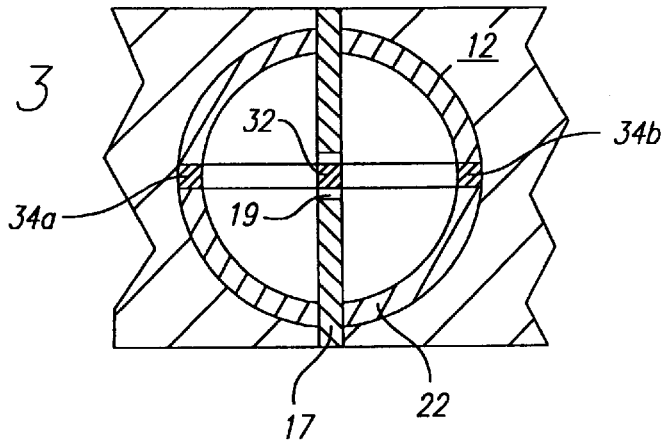
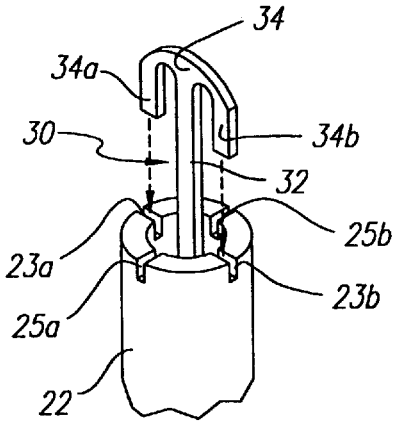
FIG. 4
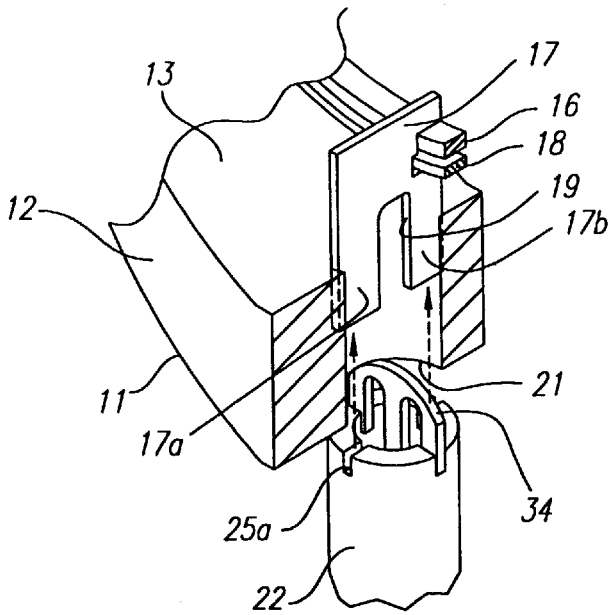
FIG. 5

DOUBLE LOOP OUTPUT SYSTEM FOR MAGNETRON

BACKGROUND OF THE INVENTION

1. Field of the Invention

The present invention relates to crossed-field devices such as magnetrons, and more particularly, to an output system for coupling RF energy out of a magnetron that damps undesired modes of oscillation of the magnetron.

2. Description of Related Art

Magnetrons are a type of crossed-field device that are commonly used to generate high power microwave energy for assorted applications, such as radar. A magnetron typically comprises a cylindrically shaped cathode that extends axially along a central axis of an anode structure comprising a plurality of anode vanes that extend radially from an annular anode ring. A space defined between the cathode surface and the anode structure provides an interaction region, and an electric potential is applied between the cathode and the anode forming a radial electric field in the interaction region. An axial magnetic field is provided in the interaction region in a direction perpendicular to the electric field by polepieces that focus magnetic flux from magnets disposed externally of the interaction region. The cathode may be provided with an internal heater disposed below the surface of the cathode to heat the cathode surface to a temperature sufficient to cause thermionic emission of electrons therefrom. The emitted electrons are caused to orbit around the cathode in the interaction region due to the axial magnetic field, during which they interact with an electromagnetic wave that is caused to move on the anode structure. The orbiting electrons give off energy to the electromagnetic wave, thus resulting in a high-power microwave output signal.

In order to put the high-power microwave output signal to use, an output circuit is provided to couple into the electric or magnetic (or both) fields that are supported in the interaction region in order to couple the output signal out of the magnetron. A typical output circuit includes a wire loop disposed in one of the cavities of the anode defined between adjacent anode vanes. The degree of coupling must be selectable, either at the design stage or as a direct adjustment on a "cold-test" as the magnetron is being built, and must remain relatively constant once selected.

A common problem with magnetrons is that they have a tendency to oscillate in a mode known as the $\pi-1$ mode instead of the desired mode (called the $\pi$ mode). A known technique for promoting oscillation in the $\pi$ mode is to provide an annular strap that couples alternating ones of the anode vanes. Another technique for promoting the $\pi$ mode is the use of an external resonant cavity of high Q. Other known techniques have focused on suppressing the $\pi-1$ mode, such as to orient the fields of the $\pi-1$ mode in such a way that neither of its doublets is left lightly coupled or uncoupled to the output system. The output circuit often represents a significant source of damping to the undesired modes oscillating in the RF structure. Should one of the doublets of the $\pi-1$ mode be left lightly coupled or totally uncoupled to the output circuit, then it is effectively free of the main source of damping of oscillations within the magnetron. In this situation, the $\pi-1$ mode may build in amplitude to such an extent that its field pattern disturbs and eventually dominates the electron trajectories. Such disturbances tend to degrade the stable and effective operation of the magnetron. There are various known techniques to achieve the orientation of the fields of the $\pi-1$ mode, e.g., slots in the cavity backs, strap-breaks, etc. Nevertheless, these techniques add complexity and manufacturing cost to the magnetron, and also introduce inductance and capacitance that alters the resonant characteristics of the magnetron.

Accordingly, it would be desirable to provide an output system for a magnetron that maintains coupling to both doublets of the $\pi-1$ mode in order to provide effective damping of undesired oscillations in the magnetron. It would also be desirable to provide an output system that can be constructed and optimized separate from the magnetron structure to provide a consistent level of performance among production devices.

SUMMARY OF THE INVENTION

In accordance with the teachings of the present invention, an output circuit is provided for magnetron that enables coupling into two adjacent anode cavities, thereby ensuring coupling to the $\pi-1$ doublets in at least one of the adjacent anode cavities. As a result, it is unnecessary to implement any method of $\pi-1$ mode orientation. Moreover, the two adjacent anode cavities are symmetrically loaded. Therefore, the $\pi-1$ mode field pattern is more uniform around the RF structure than with prior art coupling methods that couple to only a single cavity.

More particularly, the magnetron comprises an anode ring concentrically disposed around and spaced from a cathode. The anode ring further comprises a plurality of anode vanes extending radially toward the cathode with cavities being defined between adjacent ones of the plurality of anode vanes. One of the plurality of anode vanes provides an output vane whereby a high power microwave signal is developed in first and second output cavities disposed at either respective side of the output vane. The high power microwave signal is coupled out of both the first and second output cavities by a coaxial transmission line that includes first and second coupling loops disposed in the first and second output cavities, respectively. The output vane further comprises an opening at a central portion thereof. The first and second coupling loops share a common central portion that extends through the opening of the output vane without contacting the output vane. The common central portion extends outwardly of the anode ring to permit communication of the high power microwave signal therefrom. The output circuit further comprises an outer body portion that engages a corresponding bore extending radially through the anode ring. The first and second coupling loops are coupled to an end of the outer body portion that engages the anode ring. The first and second coupling loops are oriented substantially perpendicular to the output vane. The output circuit further comprises an antenna for communication of the high power microwave signal therefrom.

A more complete understanding of the double loop output system for a magnetron will be afforded to those skilled in the art, as well as a realization of additional advantages and objects thereof, by a consideration of the following detailed description of the preferred embodiment. Reference will be made to the appended sheets of drawings, which will first be described briefly.

BRIEF DESCRIPTION OF THE DRAWINGS

FIG. 3 is a sectional side view of the magnetron and output system, as taken through the section 3—3 of FIG. 1;

FIG. 4 is an exploded view of the output system showing attachment of a center conductor of a coaxial transmission line of the output system; and FIG. 5 is an exploded view showing attachment of the output system to the anode of the magnetron.

DETAILED DESCRIPTION OF THE PREFERRED EMBODIMENT

The present invention satisfies the need for an output system for a magnetron that maintains coupling with the π–1 mode to provide effective damping of undesired oscillations in the magnetron. In the detailed description that follows, like element numerals are used to describe like elements shown in one or more of the figures.

Figure 1:
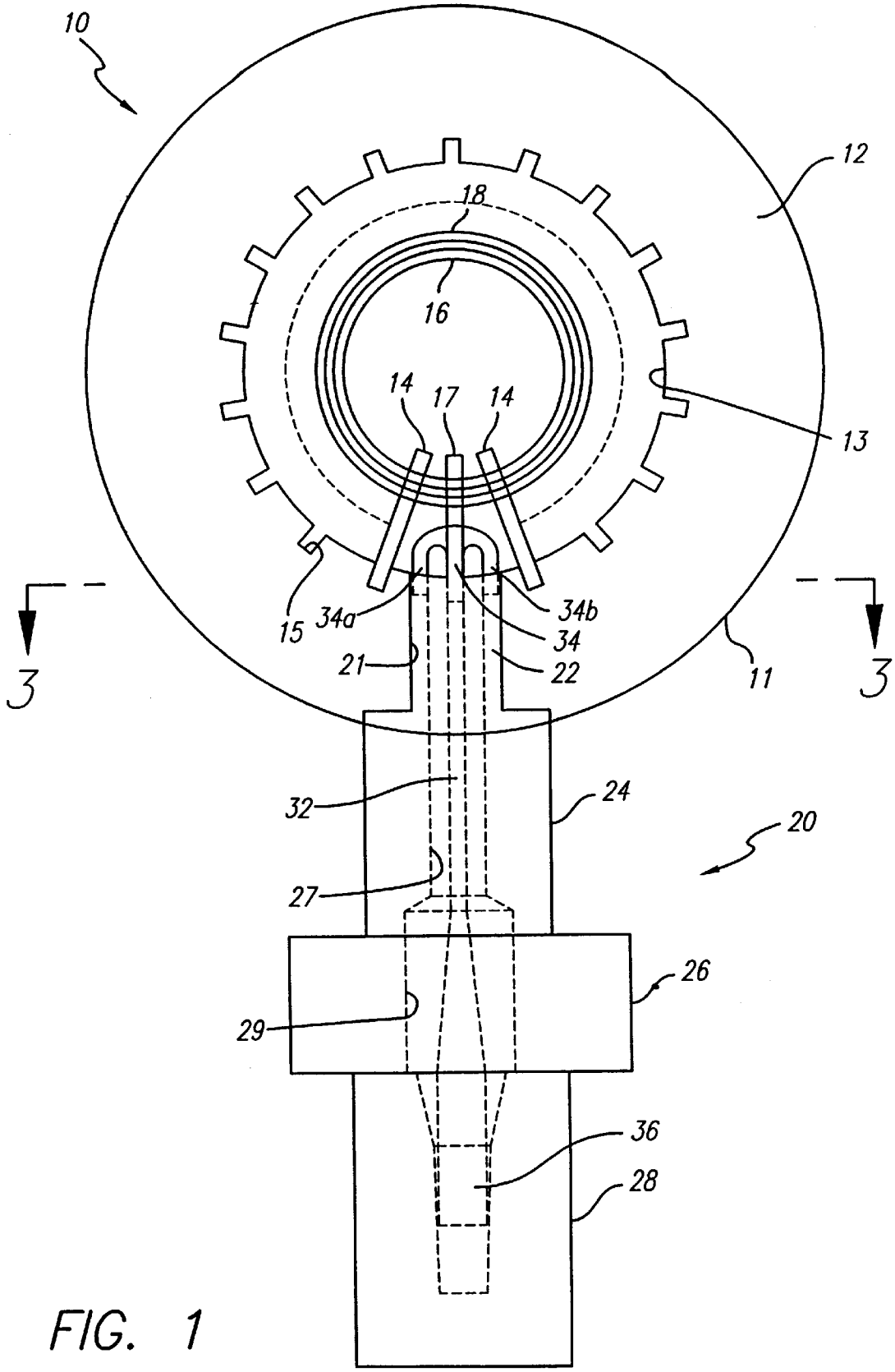
FIG. 1 is a top plan view of the magnetron and output system.
Figure 2:
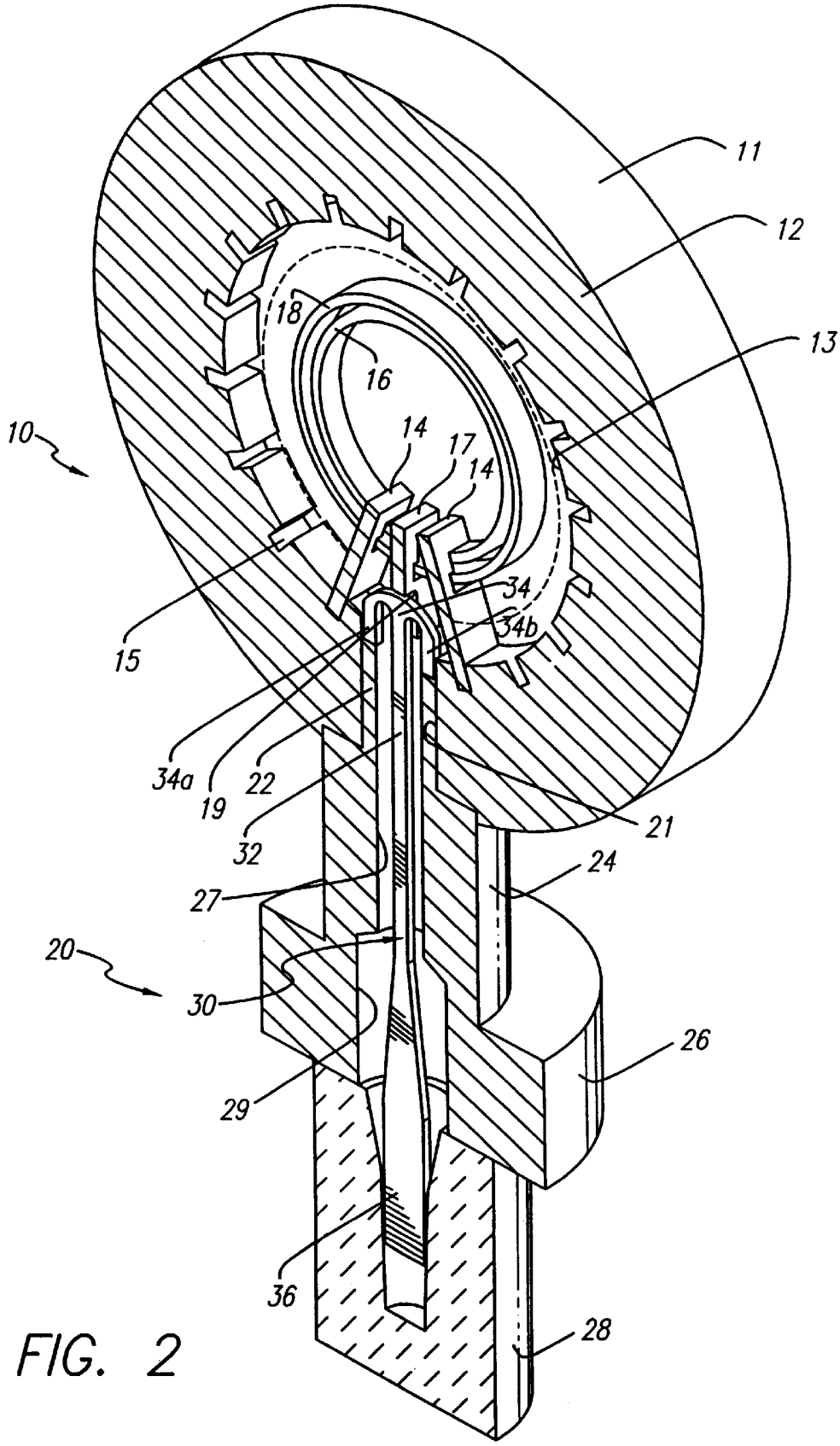
FIG. 2 is a partial perspective view of a magnetron having an output system coupled thereto in accordance with the present invention.

Referring first to FIGS. 1, 2 an exemplary magnetron 10 coupled to an output circuit 20 is illustrated. The magnetron 10 includes an annular anode ring 12 having an exterior surface 11 and an interior surface 13. The anode ring 12 is generally comprised of an electrically conductive material. A plurality of radially directed anode vanes 14 each extend inward from the interior surface 13 of the anode ring 12. The anode vanes 14 are generally rectangular and are respectively inserted into corresponding slots 15 provided in the interior surface 13. For ease of illustration, only a few of the anode vanes 14 are shown in the figures, but it should be appreciated that the anode vanes would be spaced around the entire circumference of the interior surface 13 of the anode ring 12. As known in the art, the spaces partially bounded by the sides of adjacent anode vanes 14 and the corresponding interior surface of the anode ring 12 define cavities of the magnetron. In the desired 7 mode of operation, alternate anode vanes 14 are at the same RF potential. Accordingly, the magnetron further includes straps 16, 18 that respectively couple alternating ones of the anode vanes 14 to keep them at the same RF potential and maintain separation between the frequencies of the π–1 and π–1 modes of operation.

It should be appreciated by persons skilled in the art that an operational magnetron would further comprise additional elements, such as a cathode disposed in the space interior of the tips of each of the anode vanes 14 and magnetic polepieces arranged to couple magnetic flux to the interaction region defined between the cathode and anode. These and other known aspects of the magnetron have been omitted herein for ease of illustration and description. An example of a conventional magnetron showing such known aspects is provided in U.S. Pat. No. 5,894,199, which is incorporated by reference herein.

As seen if FIG. 2, one of the anode vanes 14 provides an output vane 17. The electromagnetic signal moving on the anode builds to a maximum power level at the output cavities directly adjacent to the output vane 17. The output vane 17 is similar in size and shape of the other anode vanes 14, except that it includes a notch 19 disposed in the center of the vane and bordering with the interior surface 13 of the anode ring 12. As will be further described below, the notch 19 permits inductive coupling of electromagnetic energy out of each of the output cavities. A radial bore 21 having a circular shape extends entirely through the anode ring 12 from the exterior surface 11 to the interior surface 13. The bore 21 is disposed in alignment with the notch 19 of the output vane 17, such that the output vane divides the circular opening defined in the interior surface 13 by the radial bore 21 into two substantially equal, hemispherical portions.

The output circuit 20 comprises an output wire 30 that extends axially through the center of a generally cylindrical housing (described below), providing a coaxial connection to a coupling portion 34 disposed within the output cavities of the magnetron 10. The coupling portion 34 extends through the notch 19 of the output vane 17, and has a rounded distal end that forms a w-shaped configuration with two side legs 34*a*, 34*b* and a center leg (as best shown in FIGS. 1 and 2). The center leg of the coupling portion 34 extends axially away from the coupling portion 34 in the proximal direction to provide a center conductor 32 of the coaxial connection. As will be further described below, the coupling portion 34 does not contact the output vane 17, but rather defines a planar region substantially perpendicular to the output vane. The coupling portion 34 thereby forms a first coupling loop defined by one side leg 34*a* and the center leg in a first output cavity directly adjacent to the output vane 17, and a second coupling loop defined by the other side leg 34*b* and the center leg in a second output cavity directly adjacent to the output vane 17 (FIG. 3). The output wire 30 is comprised of electrically conductive materials, such as copper or silver-plated copper, selected in accordance with operational requirements, e.g., cost, vibration, repeatability, melting point, vapor pressure, thermal expansion coefficient, etc. The output wire 30 may be manufactured from a sheet of conductive material using stamping, electron discharge machining (EDM), laser cutting or other known manufacturing technique to achieve the desired shape.

The output circuit 20 further comprises two sections, including a coaxial section that provides a transmission line for the electromagnetic energy coupled from the magnetron and a launch section to radiates electromagnetic energy from the output circuit. The coaxial section includes a socket end 22 that is physically connected to the magnetron 10. The socket end has a cylindrical shape that is sized to directly engage the radial bore 21 of the anode ring 12. Referring briefly to FIGS. 4 and 5, the distal end of the socket end 22 has four evenly spaced, radial grooves 23*a*, 23*b* and 25*a*, 25*b*. Grooves 23*a*, 23*b* engage the side legs 34*a*, 34*b* of the output wire 30, respectively (see FIG. 4). Grooves 25*a*, 25*b* engage the tapered tail portions 17*a*, 17*b* of the output vane 17, respectively, with the distal end of the socket end 22 being substantially flush with the interior surface 13 of the anode ring 12 (see FIG. 5). The side legs 34*a*, 34*b* are thereby in effective electrical contact with the interior surface of the anode ring 12 (i.e., the side wall of each respective output cavity) by virtue of the engagement between the socket end 22 and the anode ring. It should be appreciated that the engagement between the tail portions 17*a*, 17*b* and grooves 25*a*, 25*b*, and between the side legs 34*a*, 34*b* and grooves 23*a*, 23*b* controls the angular relationship of the output vane 17 to the output wire 30. In a preferred embodiment of the invention, the output vane 17 is oriented perpendicular (i.e., 90°) to achieve maximum coupling between the magnetron 10 and the output circuit 20, but it should be appreciated that the angle may be selected to vary the degree of coupling as desired. Moreover, the self-jigging nature of the output wire 30, socket end 22 and output vane 17 mitigates in favor of rapid, repeatable and low cost manufacture.

Returning again to FIG. 2, the coaxial section of the output circuit further comprises cylindrical portions 24, 26 that are joined axially with the socket end 22. It should be appreciated that the cylindrical portions 24, 26 and socket end 22 provide an outer conductor for the coaxial transmission line, and may be machined from a single piece of conductive material. The socket end 22 and cylindrical portion 24 have a common tunnel 27 that is spaced from the center conductor 32 of the output wire 30. At approximately the boundary between the cylindrical portions 24, 26, the tunnels flare outwardly to define an enlarged tunnel region 29 Within the cylindrical portion 26. The output wire 30 also flares to a greater width in this region. It should be appreciated that the transmission characteristics of the coaxial transmission line are determined by the dimensions of the output wire and tunnel regions 27, 29, and may therefore be selected by one skilled in the art to achieve desired performance. The cylindrical portion 24 has an outside diameter greater than that of the socket end 22 to serve as a stop against the exterior surface 11 of the anode ring 12 during insertion of the socket end into the radial bore 21.

The launch section comprises an RF transparent dome having a cylindrical portion 28. The cylindrical portion 28 is comprised of dielectric materials, such as alumina or berilia ceramics. The cylindrical portion 28 includes an interior space that tapers from the width of the enlarged tunnel region 29 to a smaller inside diameter. The output wire 30 has a proximal end 36 that is wider than the center conductor 32. The proximal end 36 extends into the interior space of the cylindrical portion 28, and is held snugly within the reduced diameter space. Accordingly, the proximal end 36 of the output wire 30 extends outwardly of the conductive cylindrical portion 26 into a space enclosed by the dielectric cylindrical portion 28 of the launch section, defining an antenna extending from the coaxial transmission line. Electromagnetic energy communicated through the coaxial transmission line from the magnetron 10 radiates from the proximal end 36 in the form of an RF signal to an external transmission system. The cylindrical portion 28 of the launch section serves to enclose the vacuum within the magnetron 10.

The control and repeatability of the coupling between the output wire 30 and the external transmission system depends on the proximal end 36 being consistently positioned within the RF transparent dome. By providing the output wire 30 of a unitary structure, including the coupling loops of the coupling portion 34 and the antenna probe provided by the proximal end 36, tolerances in the positioning of the probe antenna are substantially reduced and more control over the coupling of the magnetron is achieved. The output circuit 20 can be built entirely separate from the magnetron 10, thus enabling it to be independently tested and optimized. This enhances process control of such parameters as the coupling factor. It should be appreciated that other forms of coupling to the output circuit 20 besides the radiating probe coupling may be advantageously utilized, such as a direct electrical connection of the output wire 30 to a coaxial external transmission system, or to a waveguide wall.

As described above, the coupling portion 34 of the output wire 30 does not contact the output vane 17, but is instead anchored to the interior surface 13 of the anode ring 12. The coupling loops defined by the coupling portion 34 are coupled almost exclusively to the magnetic field and hardly at all to the electric field in the output cavities. As the magnetic fields of the $\pi$ mode in adjacent cavities are in anti-phase, the induced currents in the two coupling loops will sum down the center conductor 32. The shape of the coupling loops encompasses a large area at the back of the respective output cavities (i.e., adjacent to the interior surface 13) where the magnetic fields are strongest, and less so at the front (i.e., adjacent to the innermost tip of the output vane) where the magnetic fields are weakest. Alternative shapes for the coupling loops could also be utilized depending on the resonant characteristics and desired performance of a magnetron system.

By coupling into two adjacent cavities, the cavities are more symmetrically loaded. Thus, the $\pi$ mode field pattern is more uniform around the RF structure than with known coupling methods by which only a single output cavity is utilized for coupling. Moreover, it is no longer possible for either of the $\pi$–1 doublets to be total uncoupled, because neither doublet can have a field null at both coupling loops simultaneously. Accordingly, it is unnecessary to implement any method of $\pi$–1 mode orientation, thereby reducing manufacturing costs. The overall enhancement to control of the coupling factor should therefore eliminate the need to adjusting during cold-test of an operational device, thus further educing manufacturing costs.

In an actual operational device constructed in accordance with the present invention, a $\pi$–1 radiation level of −66 dBc was achieved. Under normal conditions, a $\pi$–1 radiation level of −45 dBc is considered adequate and is generally achieved using mode-orienting techniques. A level greater than −60 dBc is considered excellent, and is even more impressive given that it was achieved without the need for mode-orienting techniques.

Having thus described a preferred embodiment of a double loop output system for a magnetron, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A microwave source, comprising:

a magnetron having an anode ring concentrically disposed around and spaced from a cathode, said anode ring further comprising a plurality of anode vanes extending radially inward from said anode ring with cavities being defined between adjacent ones of the plurality of anode vanes, one of said plurality of anode vanes providing an output vane whereby a high power microwave signal is developed in first and second output cavities disposed at opposite sides of said output vane, said output vane further comprising an opening at a central portion thereof; and an output circuit coupled to said magnetron, said output circuit comprising a coaxial transmission line including first and second coupling loops disposed in said first and second output cavities, respectively, and electrically terminated to said anode rings said first and second coupling loops sharing a common central portion that extends through said opening of said output vane without contacting said output vane, said common central portion extending outwardly of said anode ring to permit communication of said high power microwave signal therefrom, whereby said common central portion sums together an undesired mode of oscillation received by said first and second coupling loops and thereby damps said undesired mode of oscillation.

2. The microwave source of claim 1, wherein said coaxial transmission line of said output circuit further comprises an outer body portion that engages a corresponding opening of said anode ring, said common central portion extending substantially through said outer body portion while spaced from an interior surface thereof.

3. The microwave source of claim 2, wherein said first and second coupling loops are respectively coupled to an end of said outer body portion that engages said anode ring.

4. The microwave source of claim 2, where said outer body portion has a substantially cylindrical shape.

5. The microwave source of claim 1, wherein said coaxial transmission line further comprises an end portion providing an antenna for communication of said high power microwave signal therefrom.

6. The microwave source of claim 5, wherein said end portion further comprises a dome comprised of dielectric material, said common central portion extending through said outer body portion and into said dome of said end portion.

7. The microwave source of claim 6, wherein said dome further comprises a tapered internal surface, an end of said common central portion being adapted to engage said tapered internal surface.

8. The microwave source of claim 1, wherein said first and second coupling loops are respectively oriented substantially perpendicular to said output vane.

9. The microwave source of claim 1, wherein said first and second coupling loops and said common central portion comprise a unitary structure comprised of an electrically conductive material.

10. The microwave source of claim 1, wherein said first and second coupling loops and said common central portion provide a w-shaped configuration.

11. A microwave source, comprising:

a magnetron having an anode ring concentrically disposed around and spaced from a cathode, said anode ring further comprising a plurality of anode vanes extending radially inward from said anode ring with cavities being defined between adjacent ones of the plurality of anode vanes, one of said plurality of anode vanes providing an output vane whereby a high power microwave signal is developed in first and second output cavities disposed at opposite sides of said output vane, said output vane further comprising an opening at a central portion thereof; and an output circuit coupled to said magnetron, said output circuit comprising a coaxial transmission line including first and second coupling loops disposed in said first and second output cavities, respectively, and electrically terminated to said anode ring, said first and second coupling loops sharing a common central portion that extends through said opening of said output vane without contacting said output vane, said common central portion extending outwardly of said anode ring to permit communication of said high power microwave signal therefrom, whereby said common central portion sums together an undesired mode of oscillation received by said first and second coupling loops and thereby damps said undesired mode of oscillation, wherein said outer body portion further comprises a first pair of opposed notches disposed at an end thereof that engages said corresponding opening of said anode ring, said first pair of opposed notches being adapted to engage end portions of said output vane and provide alignment thereto.

12. The microwave source of claim 11, wherein said outer body portion further comprises a second pair of opposed notches disposed at an end thereof and oriented substantially perpendicular to said first pair of opposed notches, said second pair of opposed notches being adapted to engage respective ends of said first and second coupling loops.

13. In a magnetron comprising an anode ring concentrically disposed around and spaced from a cathode, said anode ring further comprising a plurality of anode vanes extending radially toward said cathode with cavities being defined between adjacent ones of the plurality of anode vanes, an output circuit comprising:

one of said plurality of anode vanes providing an output vane whereby a high power microwave signal is developed in first and second output cavities disposed at opposite sides of said output vane; and means for coupling said high power microwave signal out of both said first and second output cavities, and damping an undesired mode of oscillation by summing together said undesired mode of oscillation from both said first and second output cavities.

14. The output circuit of claim 13, wherein said coupling means comprises a coaxial transmission line including first and second coupling loops disposed in said first and second output cavities, respectively.

15. The output circuit of claim 14, wherein said output vane further comprises an opening at a central portion thereof.

16. The output circuit of claim 15, wherein said first and second coupling loops share a common central portion that extends through said opening of said output vane without contacting said output vane, said common central portion extending outwardly of said anode ring to permit communication of said high power microwave signal therefrom.

17. The output circuit of claim 16, wherein said first and second coupling loops and said common central portion comprise a unitary structure comprised of an electrically conductive material.

18. The output circuit of claim 14, wherein said first and second coupling loops are respectively oriented substantially perpendicular to said output vane.

19. The output circuit of claim 13, portion further comprising means for aligning said coupling means to said output vane.

20. The output circuit of claim 13, wherein said coupling means further comprises an antenna for communication of said high power microwave signal therefrom.

21. The output circuit of claim 20, wherein said coupling means further comprises a dome comprised of dielectric material, said antenna being disposed within said dome.

22. The output circuit of claim 13, wherein said coupling means further comprises an outer body portion that engages a corresponding opening of said anode ring.

23. The output circuit of claim 22, wherein said first and second coupling loops are respectively coupled to an end of said outer body portion that engages said anode ring.

24. The output circuit of claim 13 wherein said first and second coupling loops and said common central portion provide a w-shaped configuration.

* * * * *